US011871837B2

(12) United States Patent
Park

(10) Patent No.: US 11,871,837 B2
(45) Date of Patent: Jan. 16, 2024

(54) BAG EQUIPPED WITH DEPLOYABLE CHAIR

(71) Applicant: Yeonha Park, Incheon (KR)

(72) Inventor: Yeonha Park, Incheon (KR)

( * ) Notice: Subject to any disclaimer, the term of this patent is extended or adjusted under 35 U.S.C. 154(b) by 65 days.

(21) Appl. No.: 17/763,646

(22) PCT Filed: Feb. 9, 2021

(86) PCT No.: PCT/KR2021/001734
§ 371 (c)(1),
(2) Date: Mar. 24, 2022

(87) PCT Pub. No.: WO2021/162425
PCT Pub. Date: Aug. 19, 2021

(65) Prior Publication Data

US 2022/0338611 A1 Oct. 27, 2022

(30) Foreign Application Priority Data

Feb. 13, 2020 (KR) ..... 10-2020-0017546

(51) Int. Cl.
*A45F 4/02* (2006.01)
*A45F 3/04* (2006.01)

(52) U.S. Cl.
CPC ..... *A45F 4/02* (2013.01); *A45F 3/04* (2013.01); *A45F 2004/026* (2013.01)

(58) Field of Classification Search
CPC ..... A45F 3/04; A45F 4/02; A45F 2004/026; A47C 4/52; A45C 2009/002
USPC ..... 224/577, 155
See application file for complete search history.

(56) References Cited

U.S. PATENT DOCUMENTS 4,558,807 A * 12/1985 Jackson ..... A45B 25/24 224/258
5,374,073 A * 12/1994 Hung-Hsin ..... A45C 9/00 280/30
6,986,445 B1 * 1/2006 Stockman ..... A47C 9/10 224/155
8,016,089 B1 * 9/2011 McNichols ..... A45C 5/14 190/18 R (Continued)

FOREIGN PATENT DOCUMENTS

DE 3502923 A1 * 7/1986
JP S6015174 U 2/1985

(Continued)

OTHER PUBLICATIONS

International Search Report and Written Opinion issued in connection with corresponding patent application No. PCT/ KR2021/ 001734 dated May 14, 2021.

(Continued)

*Primary Examiner* — Scott T McNurlen
(74) *Attorney, Agent, or Firm* — TAROLLI, SUNDHEIM, COVELL & TUMMINO L.L.P.

(57) ABSTRACT

The present invention provides a bag equipped with a deployable chair. The bag comprises: a main body unit having a space therein, a seating unit rotatably coupled to the main body unit and configured to rotate so as to provide a seating space, and a support unit configured to have a variable length from the main body unit toward the ground and support the seating space.

19 Claims, 20 Drawing Sheets

(56) References Cited

U.S. PATENT DOCUMENTS

| | | | | |
|---|---|---|---|---|
| 8,113,396 | B2 * | 2/2012 | Schilly | A45F 3/047 224/155 |
| 8,820,497 | B1 * | 9/2014 | Goldsmith | A45C 5/14 190/18 A |
| 10,070,712 | B2 * | 9/2018 | Wronski | A45C 13/40 |
| 10,820,682 | B2 * | 11/2020 | Jones | A45F 3/04 |
| 2009/0184143 | A1 * | 7/2009 | Witt | A45F 3/04 224/257 |
| 2010/0133303 | A1 | 6/2010 | Schilly | |
| 2019/0142124 | A1 * | 5/2019 | Murch | A45C 13/30 190/18 R |

FOREIGN PATENT DOCUMENTS

| | | | |
|---|---|---|---|
| JP | 2001112541 | A | 4/2001 |
| JP | 3099610 | U | 4/2004 |
| JP | 4540725 | B2 | 7/2010 |
| JP | 4540725 | B2 | 9/2010 |
| JP | 201718546 | A | 1/2017 |
| KR | 20-0195064 | Y1 | 9/2000 |
| KR | 20-0365248 | Y1 | 10/2004 |
| KR | 20-0403400 | Y1 | 12/2005 |
| KR | 10-1144145 | B1 | 5/2012 |

OTHER PUBLICATIONS

Office action issued for Korean Patent No. KR10-2020-0017546, dated Jul. 27, 2021.
JP Office Action issued for JP Application No. 2022-545404, dated Aug. 22, 2023.

* cited by examiner

[Fig. 1]
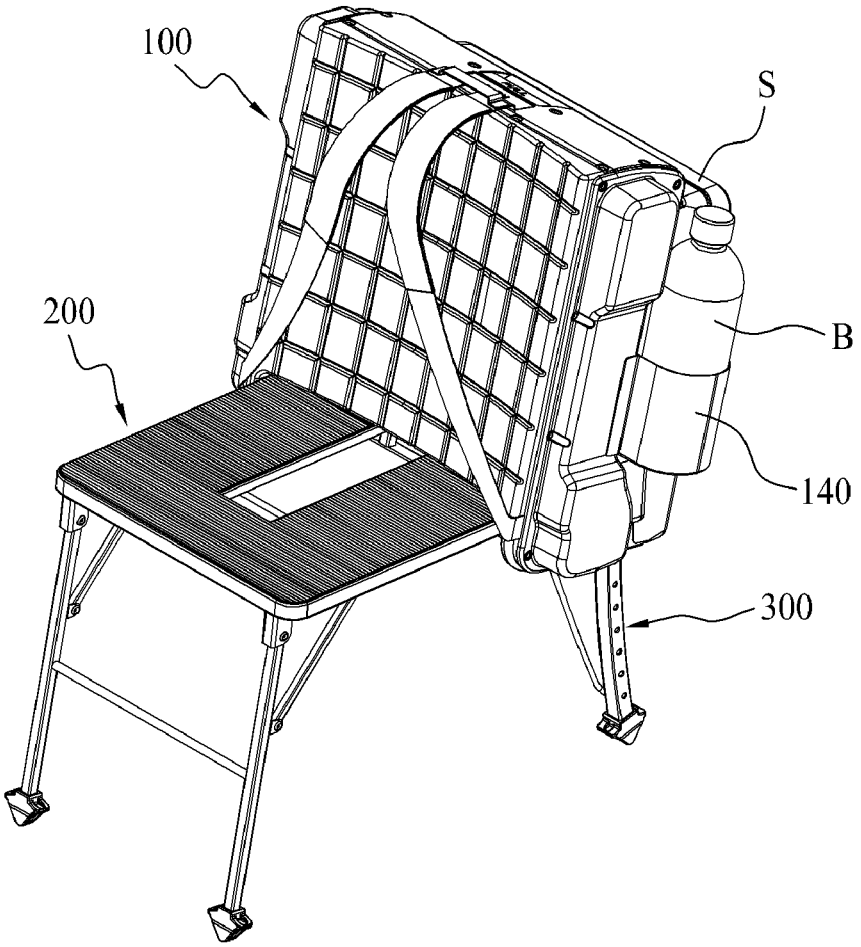

[Fig. 2]
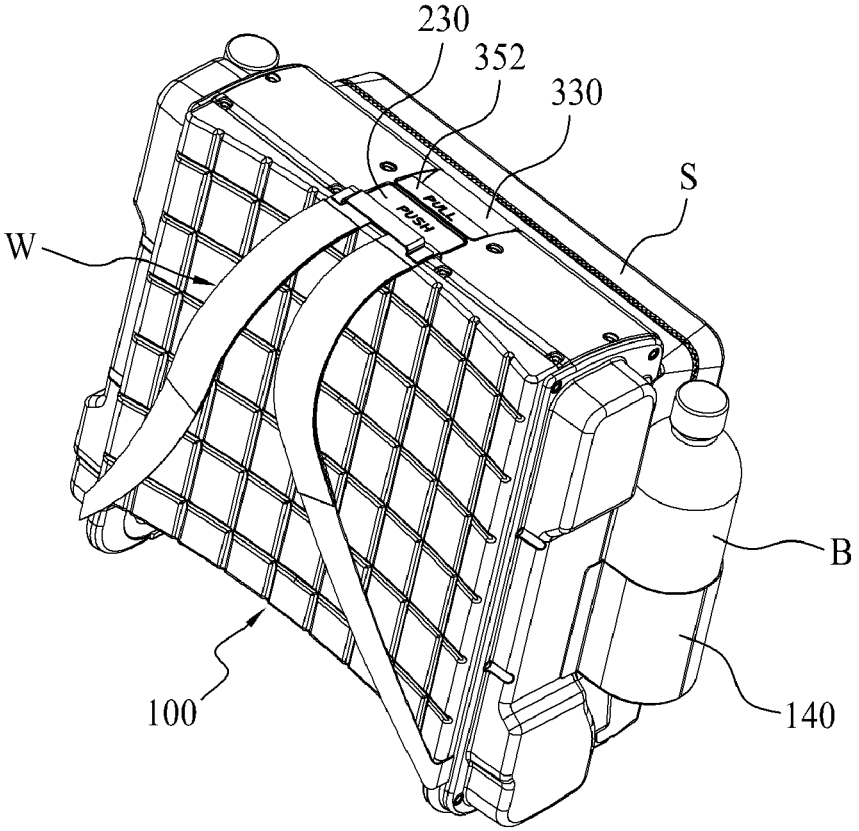

[Fig. 3]
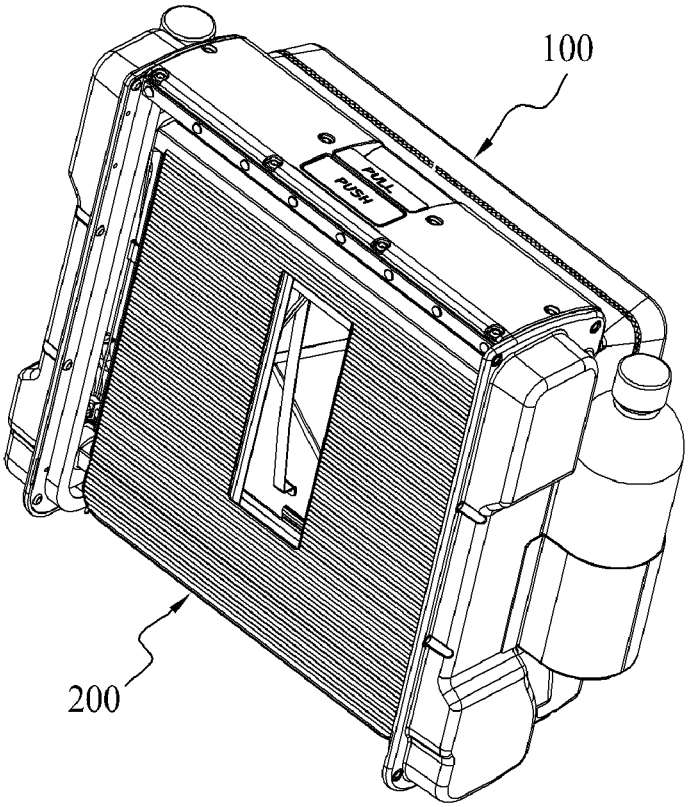

[Fig. 4]
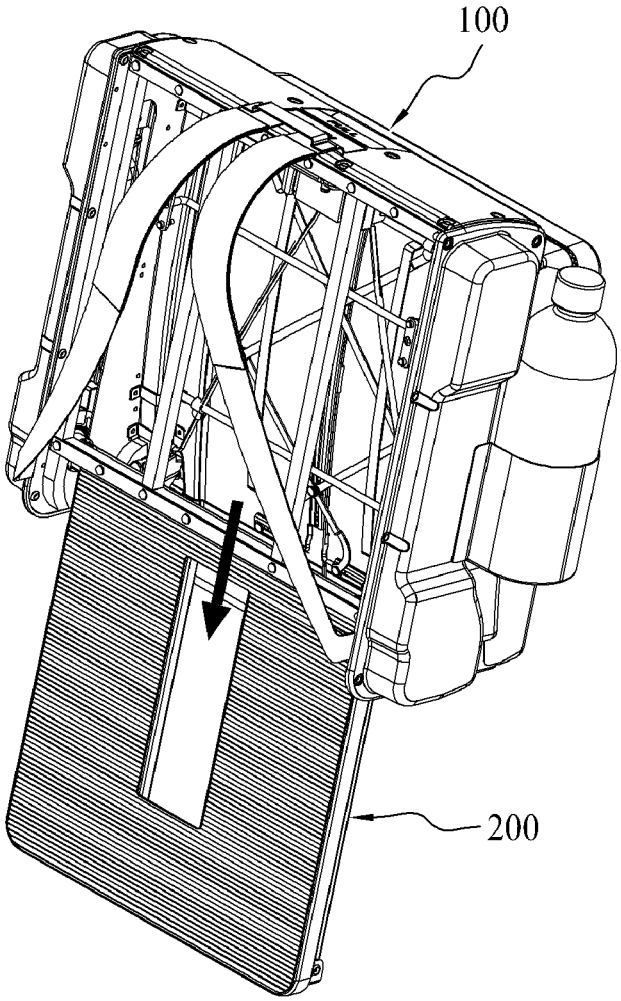

[Fig. 5]
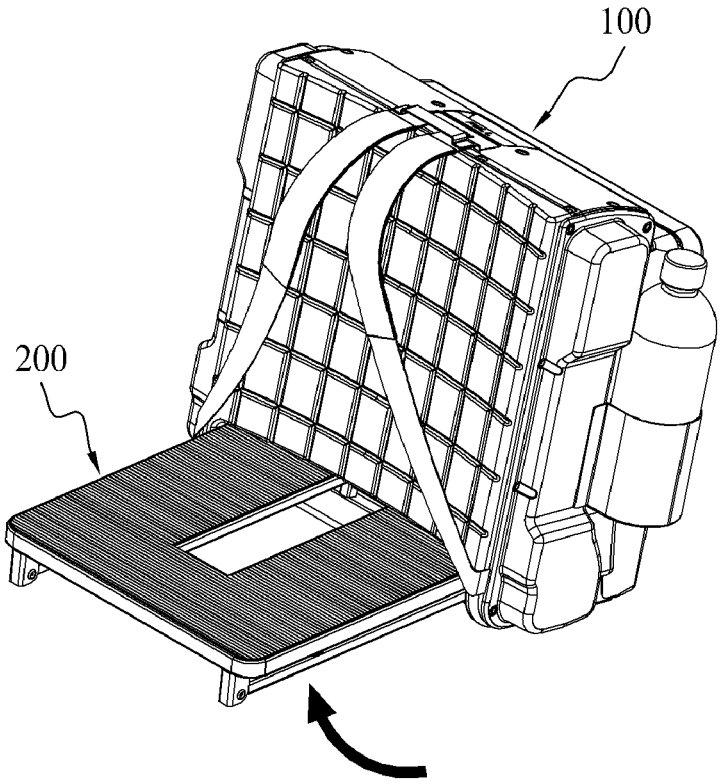

[Fig. 6]
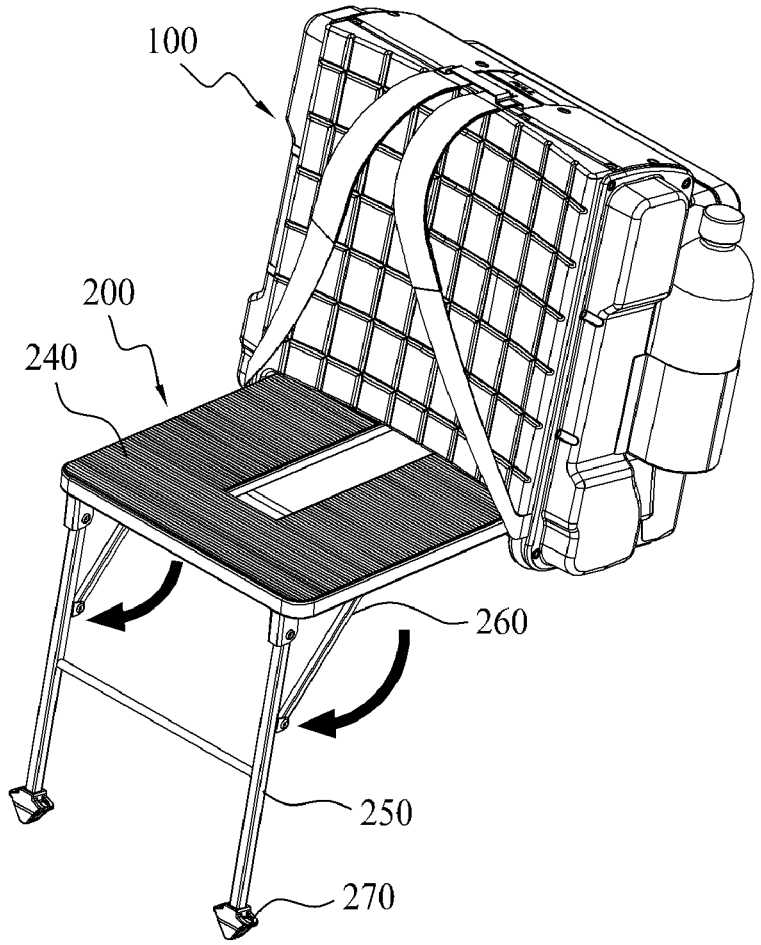

[Fig. 7]
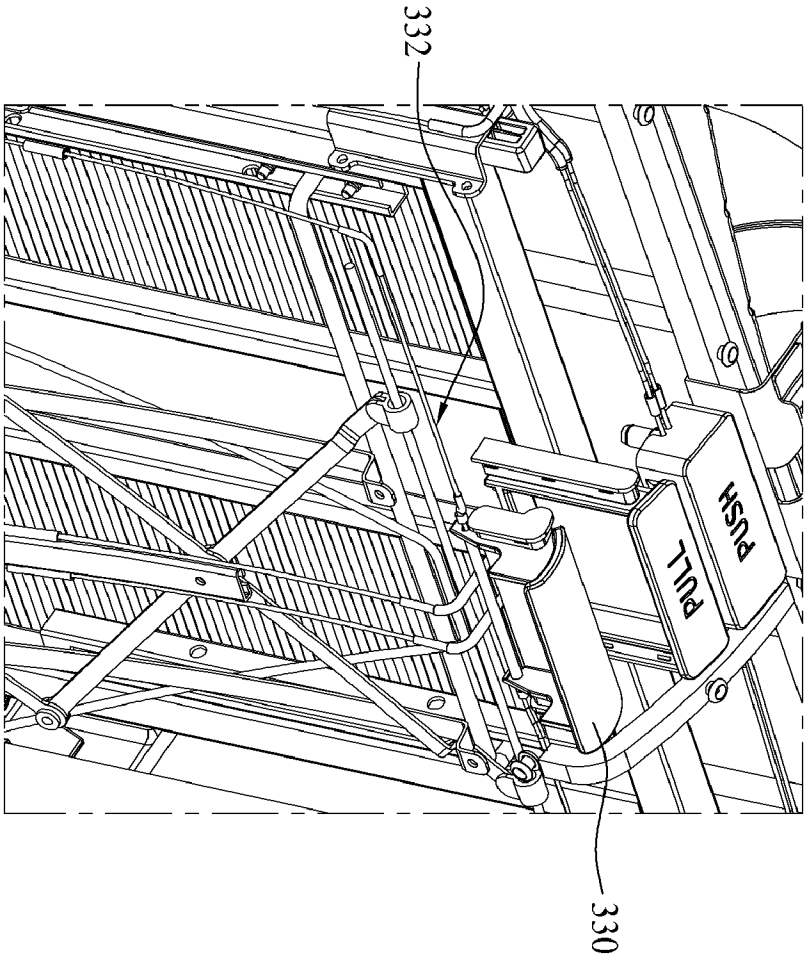

[Fig. 8]
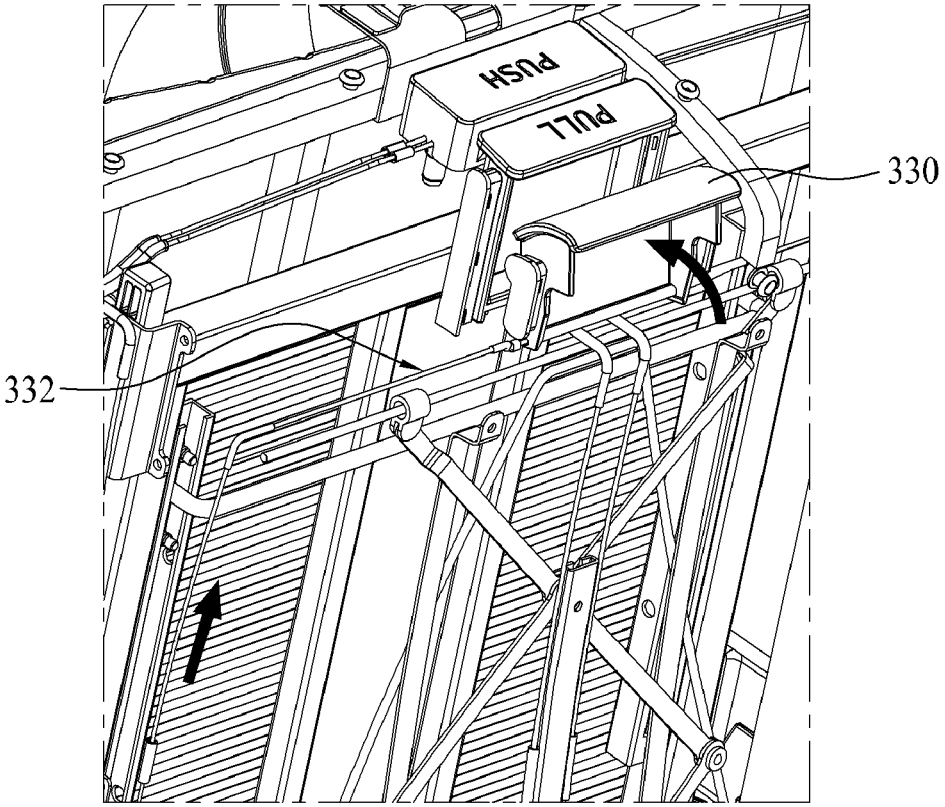

[Fig. 9]
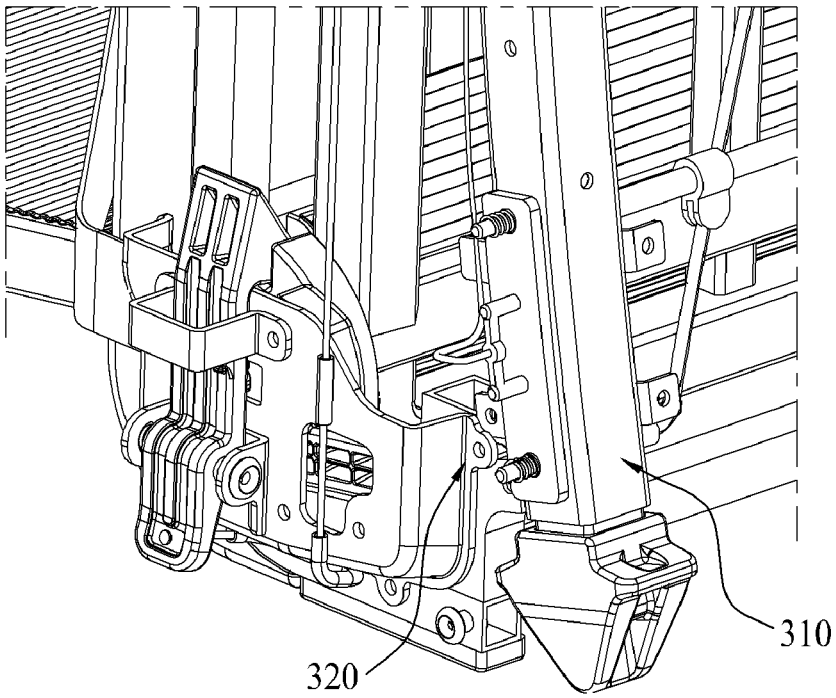

[Fig. 10]
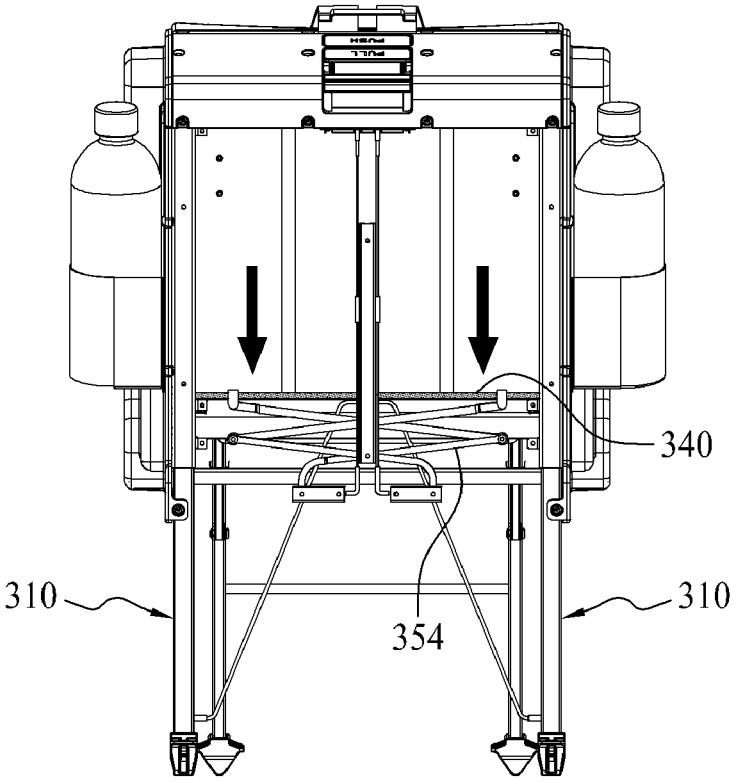

[Fig. 11]
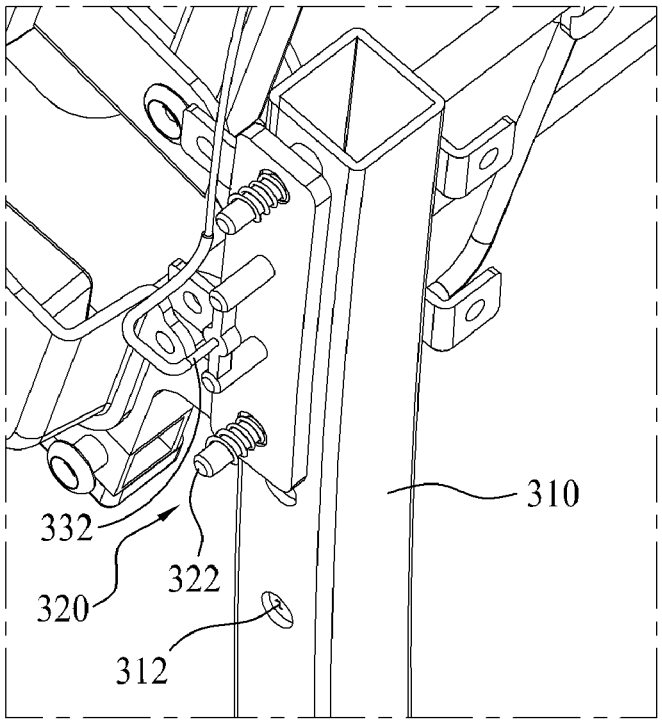

[Fig. 12]
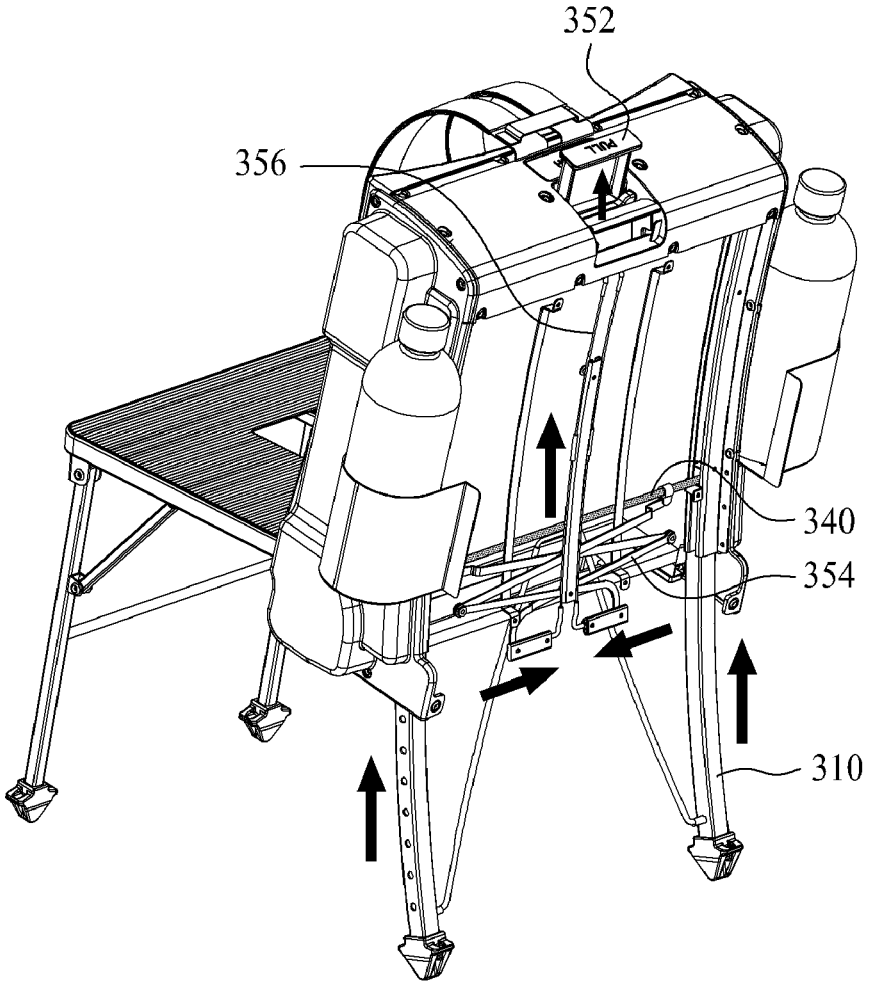

[Fig. 13]
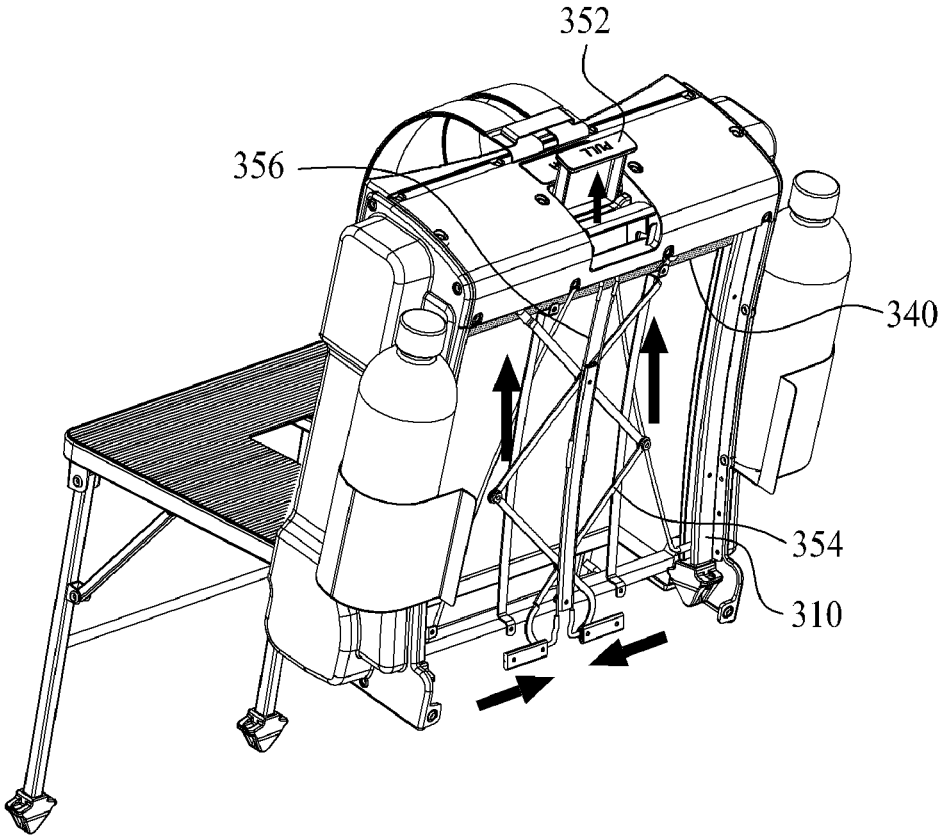

[Fig. 14]
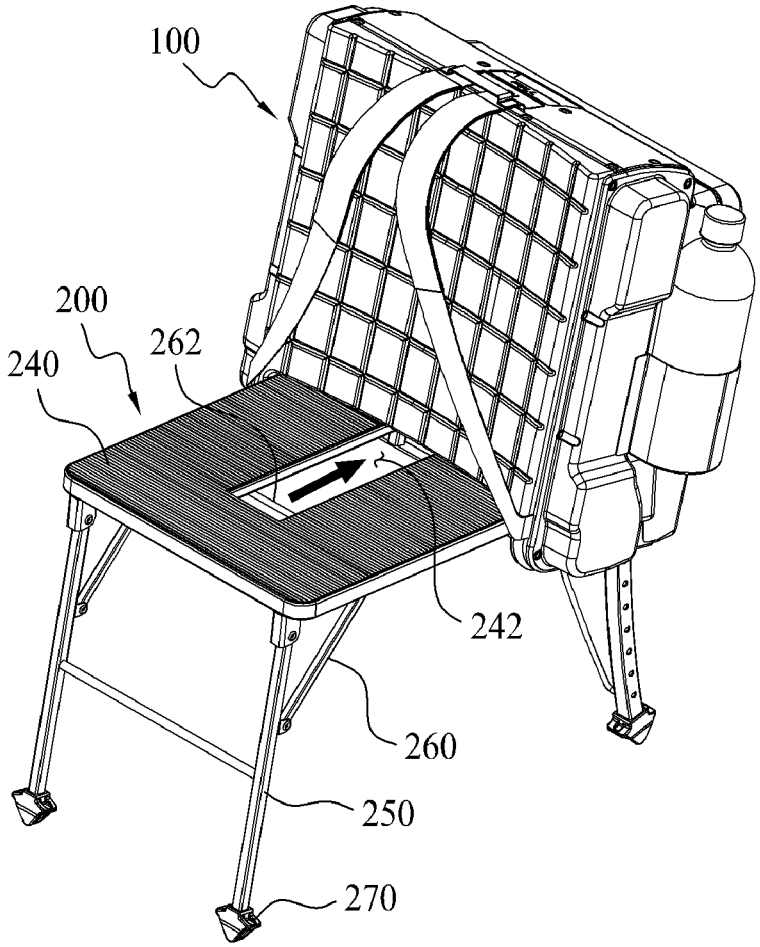

[Fig. 15]
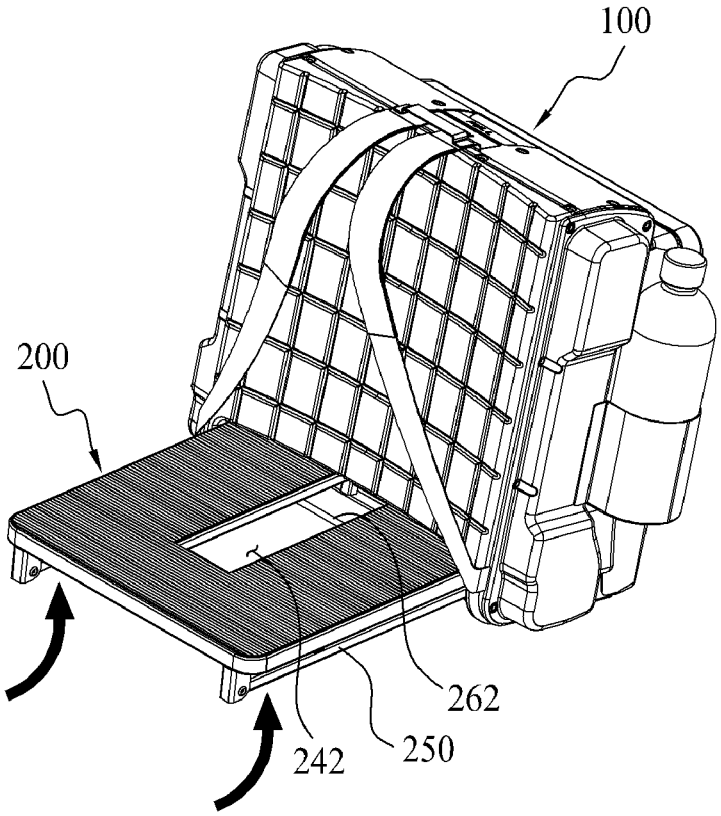

[Fig. 16]
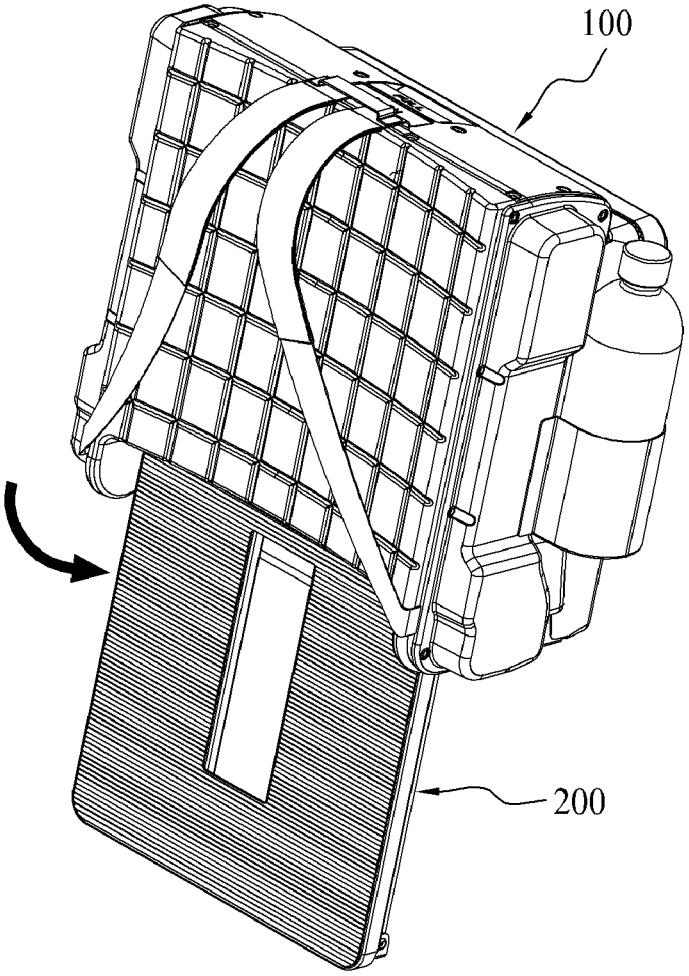

[Fig. 17]
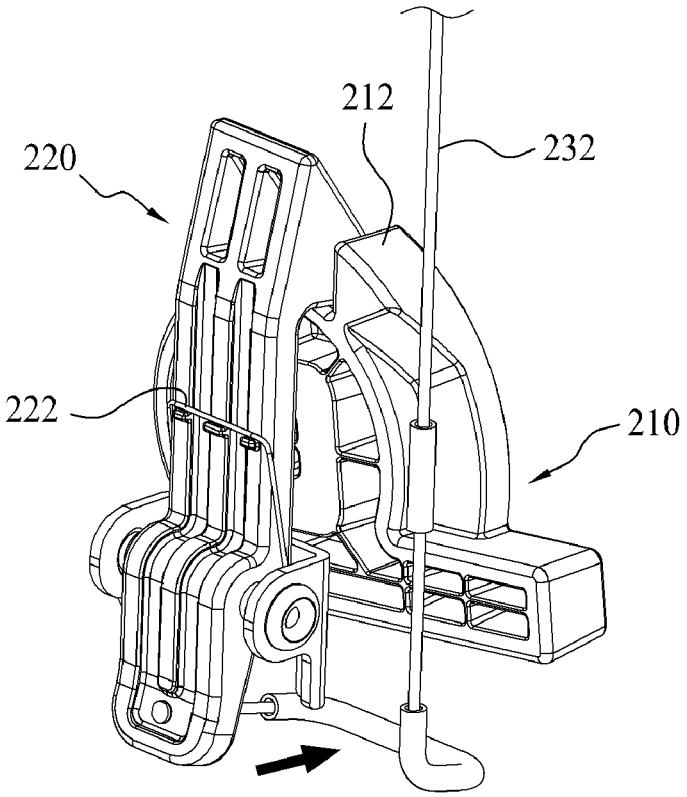

[Fig. 18]
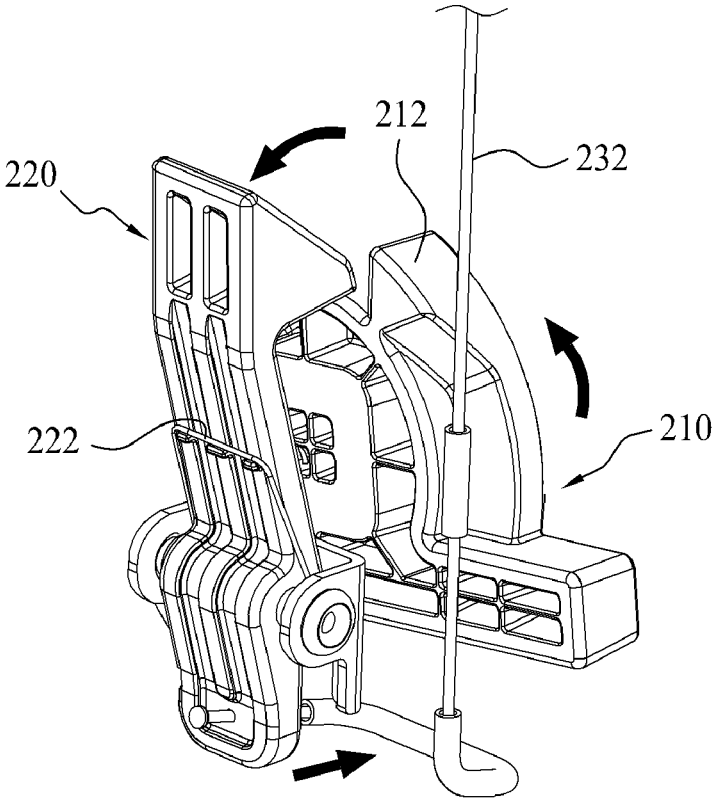

[Fig. 19]
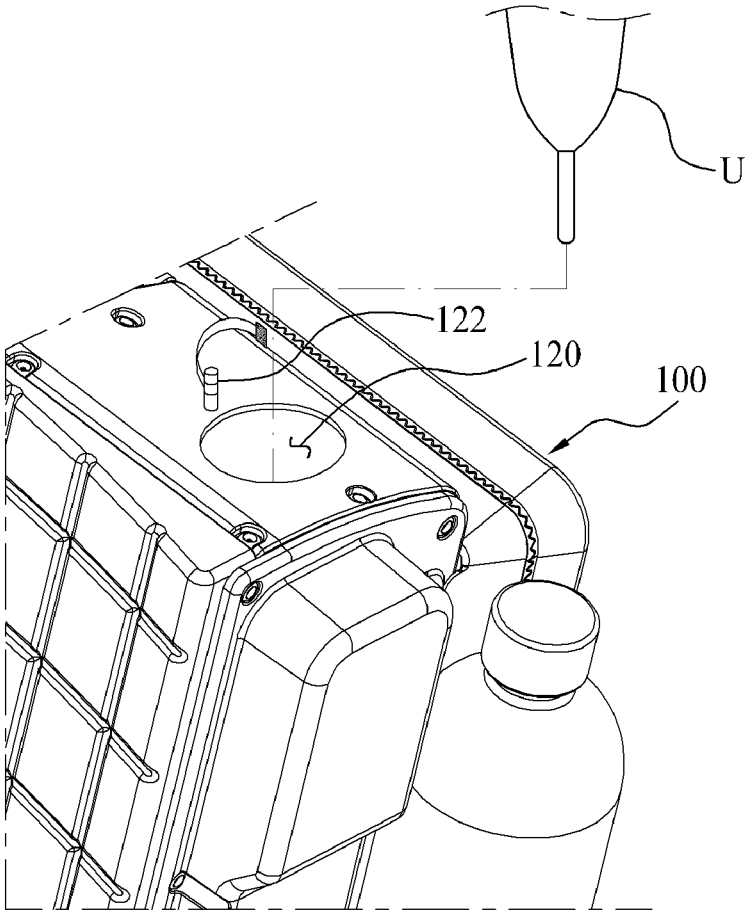

[Fig. 20]
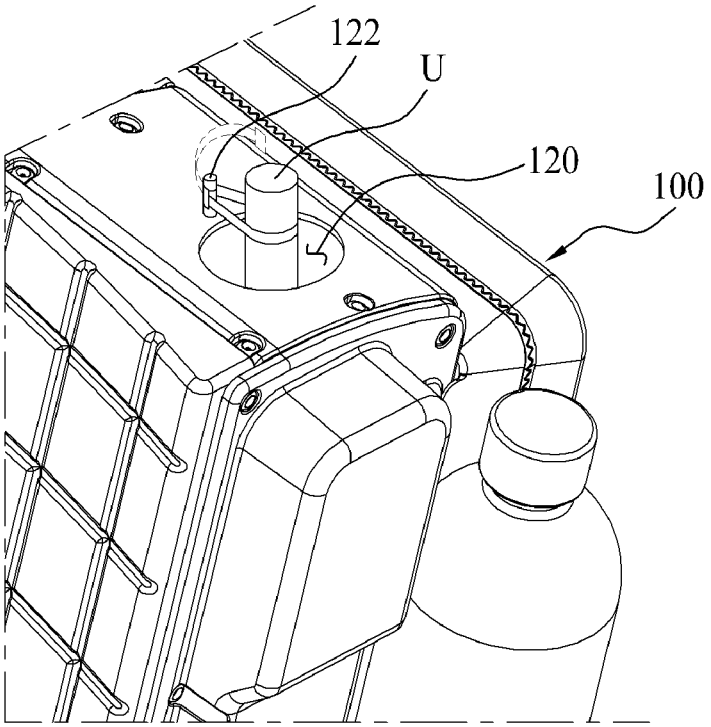

BAG EQUIPPED WITH DEPLOYABLE CHAIR

RELATED APPLICATIONS

The present invention is a U.S. National Stage under 35 USC 371 patent application, claiming priority to Serial No. PCT/KR2021/001734, filed on Feb. 9, 2021; which claims priority from Korean Patent Application No. 10-2020-0017546 filed on Feb. 13, 2020; the entireties of all are hereby incorporated herein by reference.

TECHNICAL FIELD

The present invention relates to a bag equipped with a deployable chair, and more particularly, to a bag equipped with a deployable chair, which is capable of providing a seating space by deploying an embedded chair when the seating space is needed.

BACKGROUND ART

Recently, resting areas where users may rest are provided in various spaces.

Representatively, seating spaces are provided in movie theaters, parks, bus stops, and the like so that the users may rest for waiting time.

However, in some areas, seating spaces are not smoothly provided, and the distance between resting spaces is long. For this reason, there is a problem in that old and weak persons or disabled persons feel uncomfortable while moving to the next resting space or need to stand for a long time as the waiting time increases.

For example, when a user climbs a mountain, the user needs to move a long distance to reach a resting space where the user may rest while climbing the mountain. Further, even if the user finds the resting space where the user may rest, the user cannot find a portion on which the user can sit and thus may inevitably stands or sits on an uneven ground surface such as a rock and thus the user's waist or muscle may be strained due to the uneven ground surface. In a case in which a distance from a station or stop to the user's home is long, the user may not easily find a resting space. Therefore, in these several situations, the user may not find a seating or resting space where the user may take a seat and rest when the user desires the seating or resting space.

If there is a separate product capable of providing a seating space, a user may feel uncomfortable because the user needs to additionally carry the product for providing the seating space while carrying his/her personal items and thus the number of items to be carried by the user increases. The user needs to rest within a short time interval, which may inconvenience the user because of an increased time for which the user moves.

To solve the above-mentioned problems, development is being conducted on a product capable of providing seating spaces in various spaces, and means so as for the user not to feel the product as an additional load are actively devised. Accordingly, there is a need for a method capable of solving the above-mentioned problems.

DISCLOSURE

Technical Problem

The present disclosure has been made in an effort to solve the above-mentioned problems. According to the present disclosure, a seating unit for providing a seating space is embedded in a main body unit having a space therein to provide the seating space as necessary while the user moves. Therefore, it is possible to provide the seating space regardless of locations by using the embedded seating unit while the user carries the main body unit. It is possible to adjust a gradient of the seating space by changing a length of a support unit even on an inclined or uneven ground surface. Further, a storage device for storing items, a water bottle storage part for storing a water bottle, or an umbrella storage part for storing an umbrella may be provided, such that the user may store and carry separate items together.

Technical problems of the present invention are not limited to the aforementioned technical problems, and other technical problems, which are not mentioned above, may be clearly understood by those skilled in the art from the following descriptions.

Technical Solution

To achieve the above-mentioned objects, the present disclosure provides a bag equipped with a deployable chair, the bag including: a main body unit having a space therein; a seating unit rotatably coupled to the main body unit and configured to rotate so as to provide a seating space; and a support unit configured to have a variable length from the main body unit toward the ground and support the seating space.

In this case, the support unit may change in length to adjust a gradient of the seating space according to an inclination of the ground, and the support unit may be fixed to support the seating space.

Further, the support unit may include: lifting parts each elongated toward the ground and having a plurality of holes formed in a longitudinal direction thereof, the lifting parts each being configured to move upward or downward at a lateral side of the main body unit; fixing parts each provided on the main body unit so as to be inserted into or withdrawn from the plurality of holes, the fixing parts each being configured to be inserted into any one of the plurality of holes to adjust a position of the lifting part; and a first manipulation part tiltably provided on the main body unit and connected to the fixing parts, the first manipulation part being configured to control the fixing parts so that the fixing parts are inserted into or withdrawn from the plurality of holes according to a movement position of the first manipulation part.

In this case, a lower portion of the first manipulation part and the fixing parts may be connected by means of first wire members, and the fixing parts may be inserted or withdrawn by means of the first wire members according to a tilting direction of the first manipulation part.

Meanwhile, the fixing part may have at least one or more protrusion members protruding toward the lifting part so as to be insertable into the plurality of holes.

Further, the support unit may further include: a link part configured to connect the lifting parts; and a second manipulation part coupled to the main body unit so as to be movable upward or downward in a direction perpendicular to the ground and configured to move the link part upward or downward according to the movement direction.

In this case, the second manipulation part may include: a lever member disposed at an upper side of the main body unit and configured to move the link part upward or downward; a foldable member having a plurality of panels hingedly coupled to one another while intersecting one another, the foldable member having one side and the other side respectively slidably coupled to the main body unit and the link part, respectively, wherein when two opposite ends of one side of the foldable member slide toward each other, two opposite ends of the other side of the foldable member slide toward each other, and the foldable member is extended upward as one side and the other side thereof move away from each other; and second wire members configured to connect the lever member and one side of the foldable member so that the two opposite ends of the one side of the foldable member move toward each other as the lever member moves upward.

In this case, the foldable member may be configured such that a pair of panels hingedly coupled to each other at central portions thereof while intersecting each other in an intersecting state is provided as a basic unit, a plurality of basic units are disposed in the movement direction of the link part, and the adjacent basic units are hingedly coupled to each other.

Meanwhile, the seating unit may be rotated to provide the seating space and fixed in a state in which one side of the seating unit is coupled to the main body unit by means of a shaft and the seating space is provided.

In addition, the seating unit may include: angle adjustment parts provided at two opposite ends of the shaft to rotate so that a part of the angle adjustment part has a radius of curvature about the shaft, the angle adjustment parts each having a projection formed at a periphery having the radius of curvature; catching parts provided on the main body unit so as to be tiltable toward the angle adjustment parts and each having one side that tilts toward the projection to fix a rotation of each of the angle adjustment parts; and a third manipulation part configured to control the catching part to adjust the rotations of the angle adjustment parts.

In this case, one side of the catching part, which is tilted toward the projection, may protrude toward the projection so that the rotation of the catching part is stopped as the catching part is caught by the projection.

Further, the third manipulation part may include third wire members disposed below the third manipulation part, and each of the third wire members may separate one side of the catching part from the projection by pulling the other side of the catching part toward the main body unit to remove the seating space when the third manipulation part is pressed.

Meanwhile, the seating unit may include: a seat part coupled to the main body unit and configured to rotate so as to provide the seating space; leg parts hingedly coupled to a lower portion of the seat part and configured to support the seat part while rotating toward the ground; and hinge movement parts each having one end hingedly coupled to each of the leg parts and the other end slidably coupled to the lower portion of the seat part so as to adjust a distance from the main body unit.

In this case, which when the hinge movement part slides toward the main body unit, the hinge movement part may pull the leg part and rotate the leg part toward the lower portion of the seat part.

In addition, the hinge movement part may have a bar member elongated in a direction perpendicular to a movement direction of the hinge movement part so that the hinge movement part is slid by external force.

In this case, the seat part may have a long hole formed in the movement direction of the hinge movement part so that a user moves the bar member at a location above the long hole.

Meanwhile, the main body unit may have an umbrella storage part penetratively formed toward the ground from the upper side of the main body unit 100 and configured to accommodate an umbrella.

In this case, the umbrella storage part may have a separation prevention member configured to surround a part of the umbrella by rotating toward the umbrella storage part from the main body unit, and to fix the umbrella inserted into the umbrella storage part.

In addition, the main body unit may have a water bottle storage part provided at a lateral side thereof and configured to accommodate a water bottle.

In addition, the water bottle storage part may be elastically extended or retracted to correspond to the water bottle depending on types of water bottles.

In addition, the main body unit may be coupled to a storage device disposed at a side opposite to a side at which the seating space is provided, and a storage device may be configured to accommodate an item.

Advantageous Effects

The bag equipped with the deployable chair according to the present disclosure provided to solve the above-mentioned problems has the following effects.

First, the deployable chair may be embedded in the main body unit having the space therein, such that the deployable chair may be carried.

Second, it is possible to provide the seating space regardless of locations.

Third, it is possible to adjust the gradient of the seating space by adjusting the height of the support unit when the ground surface is inclined.

Fourth, the storage device capable of storing a separate item or the water bottle storage part capable of storing a water bottle may be provided to improve the user's convenience.

The effects of the present disclosure are not limited to the aforementioned effects, and other effects, which are not mentioned above, will be clearly understood by those skilled in the art from the claims.

DESCRIPTION OF DRAWINGS

FIG. 1 is a view illustrating an overall appearance of a bag equipped with a deployable chair according to an embodiment of the present disclosure.

FIG. 2 is a view illustrating a state in which the chair is embedded in the bag equipped with the deployable chair according to the embodiment of the present disclosure.

FIG. 3 is a view illustrating an interior of the bag equipped with the deployable chair according to the embodiment of the present disclosure in a state in which the chair is embedded in the bag equipped with the deployable chair.

FIG. 4 is a view illustrating a situation in which a seat part of the bag equipped with the deployable chair according to the embodiment of the present disclosure moves toward the outside of the bag.

FIG. 5 is a view illustrating a situation in which the bag equipped with the deployable chair according to the embodiment of the present disclosure provides a seating space.

FIG. 6 is a view illustrating a situation in which leg parts rotate to support the seating space provided by the bag equipped with the deployable chair according to the embodiment of the present disclosure.

FIG. 7 is a view for explaining a first manipulation part of the bag equipped with the deployable chair according to the embodiment of the present disclosure.

FIG. 8 is a view illustrating a situation in which the first manipulation part of the bag equipped with the deployable chair according to the embodiment of the present disclosure is tilted.

FIG. 9 is a view illustrating a situation in which a lifting part of the bag equipped with the deployable chair according to the embodiment of the present disclosure is unlocked.

FIG. 10 is a view illustrating a situation in which the lifting parts of the bag equipped with the deployable chair according to the embodiment of the present disclosure move toward the ground surface.

FIG. 11 is a view for explaining a situation in which the lifting part of the bag equipped with the deployable chair according to the embodiment of the present disclosure is locked.

FIG. 12 is a view illustrating a situation in which the lifting parts of the bag equipped with the deployable chair according to the embodiment of the present disclosure are being restored.

FIG. 13 is a view illustrating a situation in which the lifting parts of the bag equipped with the deployable chair according to the embodiment of the present disclosure have been restored.

FIG. 14 is a view illustrating a situation in which the leg parts of the bag equipped with the deployable chair according to the embodiment of the present disclosure are being restored.

FIG. 15 is a view illustrating a situation in which the leg parts of the bag equipped with the deployable chair according to the embodiment of the present disclosure have been restored.

FIG. 16 is a view illustrating a situation in which the seat part of the bag equipped with the deployable chair according to the embodiment of the present disclosure is being restored.

FIG. 17 is a view illustrating an angle adjustment part of the bag equipped with the deployable chair according to the embodiment of the present disclosure.

FIG. 18 is a view illustrating a situation in which the angle adjustment part of the bag equipped with the deployable chair according to the embodiment of the present disclosure is tilted.

FIG. 19 is a view illustrating an umbrella storage part of the bag equipped with the deployable chair according to the embodiment of the present disclosure.

FIG. 20 is a view for explaining a separation prevention member of the umbrella storage part of the bag equipped with the deployable chair according to the embodiment of the present disclosure.

DESCRIPTION OF MAIN REFERENCE NUMERALS OF DRAWINGS

100: Main body unit
100: Main body unit
120: Umbrella storage part
122: Separation prevention member
140: Water bottle storage part
200: Seating unit
210: Angle adjustment part
212: Projection
220: Catching part
222: Spring member
230: Third manipulation part
232: Third wire member
240: Seat part
242: Long hole
250: Leg part
260: Hinge movement part
262: Bar member
270: Seating fixing part
300: Support unit
310: Lifting part
312: Hole
320: Fixing part
322: Protrusion member
330: First manipulation part
332: First wire member
340: Link part
350: Second manipulation part
352: Lever member
354: Foldable member
356: Second wire member

DETAILED DESCRIPTION

Hereinafter, exemplary embodiments of the present invention for specifically accomplishing the objects of the present invention will be described with reference to the accompanying drawings. In the description of the present embodiments, like terms and like reference numerals are used for like configurations, and additional descriptions for the like configurations will be omitted.

First, a configuration of a bag equipped with a deployable chair according to an embodiment of the present invention will be described with reference to FIG. 1.

Specifically, FIG. 1 is a view illustrating an overall appearance of the bag equipped with the deployable chair according to the embodiment of the present invention.

First, as illustrated in FIG. 1, the bag equipped with the deployable chair according to the embodiment of the present invention may include a main body unit 100, a seating unit 200, and a support unit 300. The main body unit 100 may have a water bottle storage part 140 configured to store a water bottle B. A storage device S may be coupled to a rear surface of the main body unit 100.

Meanwhile, to provide a seating space, the seating unit 200 may include angle adjustment parts 210, catching parts 220, a third manipulation part 230, a seat part 240, leg parts 250, hinge movement parts 260, and a seating fixing part 270.

In addition, to support the seating space, the support unit 300 may include lifting parts 310, a fixing part 320, a first manipulation part 330, a link part 340, and a second manipulation part 350.

Connection relationships and functions of the above-mentioned components will be described in more detail with reference to the drawings to be described below.

On the basis of the above-mentioned configuration, a situation in which the seating space is provided will be described with reference to FIGS. 2 to 11.

Specifically, FIG. 2 is a view illustrating a state in which the chair is embedded in the bag equipped with the deployable chair according to the embodiment of the present invention, FIG. 3 is a view illustrating an interior of the bag equipped with the deployable chair according to the embodiment of the present invention in a state in which the chair is embedded in the bag equipped with the deployable chair, FIG. 4 is a view illustrating a situation in which the seat part of the bag equipped with the deployable chair according to the embodiment of the present invention moves toward the outside of the bag, FIG. 5 is a view illustrating a situation in which the bag equipped with the deployable chair according to the embodiment of the present invention provides a seating space, FIG. 6 is a view illustrating a situation in which the leg parts rotate to support the seating space provided by the bag equipped with the deployable chair according to the embodiment of the present invention, FIG. 7 is a view for explaining the first manipulation part of the bag equipped with the deployable chair according to the embodiment of the present invention, FIG. 8 is a view illustrating a situation in which the first manipulation part of the bag equipped with the deployable chair according to the embodiment of the present invention is tilted, FIG. 9 is a view illustrating a situation in which the lifting part of the bag equipped with the deployable chair according to the embodiment of the present invention is unlocked, FIG. 10 is a view illustrating a situation in which the lifting parts of the bag equipped with the deployable chair according to the embodiment of the present invention move toward the ground surface, and FIG. 11 is a view for explaining a situation in which the lifting part of the bag equipped with the deployable chair according to the embodiment of the present invention is locked.

First, as illustrated in FIG. 2, the main body unit 100 may have a space therein, and the seating unit 200 and the support unit 300 may be disposed inside the main body unit 100. As described above, the main body unit 100 may have the water bottle storage part 140 configured to store the water bottle B, and the water bottle storage part 140 may be formed elastically to be extended or retracted and fix the water bottle B to correspond to a periphery of the water bottle B depending on the type of water bottle B.

In addition, the storage device S may be coupled to the rear surface of the main body unit 100, i.e., a surface of the main body unit 100 opposite to a side at which the seating space is to be provided. Therefore, a user, who intends to use the bag according to the present invention may store separate items, which the user intends to carry, in the storage device S.

In addition, the main body unit 100 may have straps W that enables the user to carry the main body unit 100 so that the user may provide the seating space as necessary while moving. FIG. 2 illustrates a pair of straps S, but the strap W may be designed in various ways according to the direction of the seating space with which those skilled in the art intend to provide the user.

In this case, when the user intends to have the seating space by deploying the seating unit 200 and the support unit 300 from the main body unit 100 when the user moves while carrying the main body unit 100, the user may have the seating space by operating the first manipulation part 330, the second manipulation part 350, and the third manipulation part 230 illustrated in FIG. 2.

The interior of the main body unit 100 will be described with reference to FIG. 3 in order to describe the above-mentioned configuration in more detail. The seating unit 200 may be accommodated in the main body unit 100.

In addition, as illustrated in FIG. 4, when the user intends to have the seating space as necessary, the user may have the seating space by moving the seating unit 200 toward the ground surface.

FIG. 4 illustrates a configuration in which the seating unit 200 moves toward the ground surface to provide the seating space. However, unlike FIG. 4, one side of the seating unit 200 may be hingedly coupled to a lower portion of the main body unit 100, and the seating unit 200 may rotate toward the ground surface to provide the seating space.

In this case, as illustrated in FIG. 4, to move the seating unit 200 toward the ground surface from the main body unit 100, a separate groove, through which the seating unit 200 may move toward the ground surface, may be formed in the main body unit 100. A guide part (not illustrated) capable of guiding the movement of the seating unit 200 toward the ground surface may be formed.

To have the seating space, the user may rotate the seating unit 200 toward an upper side of the main body unit 100 while moving the seating unit 200, which is accommodated in the main body unit 100, toward the ground surface as described above.

In addition, when the seating unit 200 rotates to provide the seating space, the seating unit 200 may fix the seating space by using the angle adjustment part 210 and the catching part 220 so that the seating unit 200 may be fixed in the state in which the seating space is provided.

In this case, the angle adjustment part 210 and the catching part 220 will be described in more detail with reference to the drawings to be described below.

Further, in the state in which the seating space is provided, the seating unit 200 may include the seat part 240 made of cotton or fibers, rotatably coupled to the main body unit 100, and configured to provide the seating space, the leg parts 250 hingedly coupled to a lower portion of the seat part 240 and configured to support the seating space provided by the seat part 240 while rotating toward the ground surface, and the hinge movement parts 260 each having one end connected to the leg part 250 and the other end slidably coupled to the lower portion of the seat part 240.

In this case, one side of the seat part 240 may be coupled to the main body unit 100 so that the seat part 240 may be hingedly coupled to the main body unit 100 and provide the seating space while rotating. The leg part 250 may have a length corresponding to the seat part 240 and rotate toward the ground surface from the lower portion of the seat part 240 to support the seating space. One end of the hinge movement part 260 may be coupled to the leg part 250, and the other end of the hinge movement part 260 may be slidably coupled to the lower portion of the seat part 240 and guide a movement of the leg part 250 while sliding.

In addition, the hinge movement part 260 may have a rail configured to guide the sliding motion of the other end of the hinge movement part 260. As the hinge movement part 260 moves, the leg part 250 may rotate toward the ground surface or the lower portion of the seat part 240 in conjunction with the movement of the hinge movement part 260.

Further, the seating fixing parts 270 may be provided between the ground surface and the leg parts 250 and fix the leg parts 250 to prevent the seat part 240 from swaying when the seat part 240 provides the seating space. The seating fixing parts 270 may be partially inserted into the ground surface to fix the leg parts 250.

Therefore, the seating fixing part 270 may be tapered toward the ground surface so that the seating fixing part 270 may be partially inserted into the ground surface.

Further, the support unit 300 may be provided inside the main body unit 100 and support the other side of the seating space by moving toward the ground surface when the seating unit 200 provides the seating space and the leg parts 250 support one side of the seating space.

In this case, the support unit 300 may be changed in length depending on an inclination of the ground surface and adjust a gradient of the seating space, and the support unit 300 may be fixed to support the seating space. Therefore, the support unit 300 may include the lifting parts 310 elongated toward the ground surface, the fixing parts 320 configured to adjust positions of the lifting parts 310, and the first manipulation part 330 tiltably provided on the main body unit 100, connected to the fixing parts 320, and configured to fix positions of the lifting parts 310 by adjusting the fixing parts 320 according to movement positions thereof.

In this case, the first manipulation part 330 may be provided on the upper portion of the main body unit 100, and the first manipulation part 330 may tilt to move the support unit 300 toward the ground surface to adjust the gradient of the seating space. As illustrated in FIG. 7, the fixing parts 320 and the first manipulation part 330 may be connected by means of first wire members 332 so that the first manipulation part 330 may adjust the fixing parts 320.

In this case, the first wire members 332 may be connected to a lower portion of the first manipulation part 330. The first manipulation part 330 may move and pull the first wire members 332 while tilting, and the fixing parts 320 may be pulled by the first wire members 332 in the movement direction of the first manipulation part 330.

In this case, as illustrated in FIG. 8, when the first manipulation part 330 tilts, the first wire members 332 may pull the fixing parts 320 inserted into the lifting parts 310, and the fixing parts 320 may be withdrawn from the lifting parts 310, such that the lifting part 310 is unlocked.

In more detail, as illustrated in FIG. 9, the lifting part 310 may have a plurality of holes 312 formed in a longitudinal direction thereof. The lifting part 310 may be unlocked when a plurality of protrusion members 322 formed on the fixing part 320 is withdrawn from the plurality of holes 312 by the first wire member 332 in a state in which the plurality of protrusion members 322 is inserted into the plurality of holes 312. Therefore, the lifting part 310 may move toward the ground surface.

As described above, the lifting part 310 may be unlocked as the plurality of protrusion members 322 is withdrawn from the lifting part 310 by the first wire member 332 in the tilting movement direction of the first manipulation part 330, and the lifting part 310 may move toward the ground surface, as illustrated in FIG. 10.

In addition, the link part 340, which is disposed between the lifting parts 310 and connects the lifting parts 310 respectively provided at the lateral sides of the main body unit 100, may move together with the lifting part 310 toward the ground surface as the lifting parts 310 move toward the ground surface. The link part 340 may allow one side and the other side of a foldable member 354 to move away from each other. The foldable member 354 may include a plurality of panels hingedly coupled to one another while intersecting one another and has one side and the other side respectively slidably coupled to the main body unit 100 and the link part 340.

In more detail, as illustrated in FIG. 11, the plurality of holes 312 may be formed in the longitudinal direction of the lifting part 310 so that the plurality of protrusion members 322 may be inserted into the plurality of holes 312 formed in the lifting part 310 as illustrated. The protrusion members 322 may be withdrawn from the plurality of holes 312 as the first wire member 332 pulls the fixing part 320 in the tilting direction of the first manipulation part 330.

As described above, the user may have the seating space while the user moves or as necessary. The user may carry the main body unit 100 by using the straps W provided on the main body unit 100 and have the seating space according to the user's convenience.

When the user intends to remove the seating space, the user may perform an operation of removing the seating space as described with reference to FIGS. 12 to 18.

Specifically, FIG. 12 is a view illustrating a situation in which the lifting parts of the bag equipped with the deployable chair according to the embodiment of the present invention are being restored, FIG. 13 is a view illustrating a situation in which the lifting parts of the bag equipped with the deployable chair according to the embodiment of the present invention have been restored, FIG. 14 is a view illustrating a situation in which the leg parts of the bag equipped with the deployable chair according to the embodiment of the present invention are being restored, FIG. 15 is a view illustrating a situation in which the leg parts of the bag equipped with the deployable chair according to the embodiment of the present invention have been restored, FIG. 16 is a view illustrating a situation in which the seat part of the bag equipped with the deployable chair according to the embodiment of the present invention is being restored, FIG. 17 is a view illustrating the angle adjustment part of the bag equipped with the deployable chair according to the embodiment of the present invention, and FIG. 18 is a view illustrating a situation in which the angle adjustment part of the bag equipped with the deployable chair according to the embodiment of the present invention is tilted.

First, a process of restoring the support unit 300 will be preferentially described with reference to FIG. 12. To restore the support unit 300, the second manipulation part 350 may be used to restore the lifting parts 310. The second manipulation part 350 may be coupled to the main body unit 100 so as to move upward or downward and control the movement of the link part 340 in the movement direction.

To restore the lifting parts 310 to remove the seating space, the positions of the lifting parts 310 may be preferentially unlocked by unlocking the fixing parts 320 by operating the first manipulation part 330 as described above, and the lifting parts 310 may be moved toward the inside of the main body unit 100 by operating the second manipulation part 350.

In this case, as illustrated in FIG. 12, the second manipulation part 350 may include a lever member 352 coupled to the main body unit 100 so as to be movable upward and downward and configured to move the link parts 340 while moving upward or downward, the foldable member 354 including the plurality of panels hingedly coupled to one another while intersecting one another, the foldable member 354 having one side and the other side respectively slidably coupled to the main body unit 100 and the link part 340, and second wire members 356 configured to connect one side of the foldable member 354 and a lower portion of the lever member 352 and to move one side of the foldable member 354 such that the link part 340 moves in the movement direction of the lever member 352.

In this case, as illustrated in FIG. 12, the lever member 352 disposed at the upper side of the main body unit 100 may pull the second wire members 356 connected to the lower portion thereof while moving upward, and the second wire members 356 may be pulled upward by the lever member 352 and thus pull one side of the foldable member 354 in a direction in which two opposite ends of one side of the foldable member 354 become close to each other.

When the two opposite ends of one side of the foldable member 354 move toward each other or one side of the foldable member 354 moves in the movement direction of the second wire member 356 as described above, the plurality of panels intersecting one another is spread as the two opposite ends of one side of the foldable member 354 become close to each other. Therefore, two opposite ends of the other side of the foldable member 354 may move toward each other on the link part 340, thereby moving the link part 340 toward the upper side of the main body unit 100.

As described above, when the lever member 352 is pulled, the two opposite ends of one side of the foldable member 354 may move toward each other, and the two opposite ends of the other side of the foldable member 354 may slide toward each other on the link part 340, such that the link part 340 may be moved toward the upper side of the main body unit 100, and the link part 340 may move the lifting parts 310 toward the inside of the main body unit 100.

In this case, the configuration in which the foldable member 354 includes the plurality of panels hingedly coupled to one another while intersecting one another has been described above. However, in more detail, an X-shaped coupling unit having a plurality of panels coupled to one another at centers thereof may be provided as a basic coupling unit, a plurality of basic coupling units may be arranged toward the upper side of the main body unit 100 from the inside of the main body unit 100, and the adjacent basic coupling units may be hingedly coupled to each other.

The foldable member 354 including the plurality of panels hingedly coupled to one another while intersecting one another may move the link part 340 toward the upper side of the main body unit 100, i.e., in the movement direction of the lever member 352. Further, the lever member 352 may move upward by a distance by which one side of the foldable member 354 moves, and the link part 340 may move upward or downward by a distance longer than a distance by which the lever member 352 moves upward or downward. As a result, the user may easily restore the lifting parts 310 by moving the lever member 352 by a short distance.

For example, if a movement distance of the lifting parts 310 is equal to a movement distance of the lever member 352, the user needs to consistently pull the lever member 352 until the lifting parts 310 are moved upward. Therefore, it may be hard for old and weak persons, who substantially need the seating space, to consistently pull and move the lever member 352 upward. Therefore, the foldable member 354 may include the plurality of panels hingedly coupled to one another while intersecting one another, which makes it possible to allow the user to restore the lifting part 310 by pulling the lever member 352 by a short distance.

When the two opposite ends of one side of the foldable member 354 move toward each other as described above, the lifting parts 310 may be moved toward the inside of the main body unit 100, as illustrated in FIG. 13. In the state in which the lifting parts 310 are moved upward, the user may tilt the first manipulation part 330 like a state before the first manipulation part 330 is tilted, thereby allowing the fixing parts 320 to fix the positions of the lifting parts 310.

When the user intends to restore the seating unit 200 to remove the seating space, the user may operate the seating unit 200 as illustrated in FIG. 14.

In this case, the seating unit 200 may include the seat part 240, the leg parts 250, and the hinge movement parts 260, as described above. A bar member 262 may be configured to connect the hinge movement parts 260 provided at the two opposite sides of the lower portion of the seat part 240 so that the hinge movement parts 260 may move in conjunction with each other.

In this case, the user may simply rotate the leg parts 250 toward the lower portion of the seat part 250 by applying external force thereto. However, the user may also move the other side of each of the hinge movement parts 260 toward the main body unit 100 by moving the bar member 262, which is formed to be perpendicular to the movement direction of the hinge movement part 260, toward the main body unit 100 so that the other side of each of the hinge movement parts 260 moves toward the main body unit 100, and pull each of the leg parts 250 hingedly coupled to one side of each of the hinge movement parts 260, thereby rotating the leg parts 250 toward the lower portion of the seat part 240.

In this case, the seat part 240 may have a long hole 242 elongated in the movement direction of the hinge movement parts 262 to allow the user to simply move the bar member 262 at a location above the seating space.

When the user intends to restore the seating unit 200 by using the above-mentioned configuration, the user may move the bar member 262 toward the main body unit 100. Therefore, the other side of each of the hinge movement parts 260 connected to the bar member 262 may be moved toward the main body unit 100, and the leg parts 250 each hingedly coupled to one side of each of the hinge movement parts 260 may be rotated toward the lower portion of the seat part 240.

In addition, when the leg parts 250 have been restored as illustrated in FIG. 15, the user may rotate the seat part 240 toward the ground surface in order to move.

As illustrated in FIG. 16, the user may remove the seating space by moving the seat part 240 toward the inside of the main body unit 100 while rotating the bar member, and the user may carry the main body unit 100 by using the straps W coupled to the main body unit 100.

However, as illustrated in FIG. 17, the seating unit 200 may fix the seating space by using the angle adjustment parts 210 and the catching parts 220 to prevent the rotation of the seating space in the state in which the seating space is provided.

Specifically, when the seat part 240 rotates to provide the seating space, the angle adjustment parts 210 provided at two opposite ends of a rotary shaft of the seating unit 200 may also rotate. A part of the angle adjustment part 210 may be formed to have a radius of curvature about the rotary shaft, and a projection 212 may be formed at a periphery having the radius of curvature. The seating unit 200 may include the catching part 220 tiltable toward the angle adjustment part 210, having one side tilting toward the projection 212, and configured to fix the rotation of the angle adjustment part 210, and the third manipulation part 230 configured to adjust the rotation of the angle adjustment part 210 by controlling the catching part 220.

In this case, the angle adjustment part 210 may fix the seating space by rotating together with the seat part 240, and one side of the catching part 220, which rotates toward the projection 212, may protrude toward the projection 212, thereby fixing the rotation of the projection 212.

In this case, the catching part 220 may include a spring member 222 configured to press one side of the catching part 220 and maintain a fixed state of the seat part 240. The angle adjustment part 210 may be fixed by the catching part 220 that rotates toward the projection 212.

To remove the seating space, the angle adjustment part 210 fixed as described above may be unlocked by the third manipulation part 230 connected to the other side of the catching part 220 by means of third wire members 232.

In this case, the third wire members 232 may be disposed below the third manipulation part 230. When the third manipulation part 230 is pressed by the external force, the third wire member 232 may pull the other side of the catching part 220, and the catching part 220 may deviate from a rotation route of the projection 212 by the third wire member 232, such that the angle adjustment part 210 may be unlocked.

As described above, the catching part 220 may be inserted into the main body unit 100 by rotating the seat part 240 toward the ground surface while pressing the third manipulation part 330 to unlock the angle adjustment part 210.

As described above, the user may have the seating space at any time in a desired space at a desired time while carrying the main body unit 100 by performing the processes of providing and removing the seating space by using the configuration of each of the main body unit 100, the seating unit 200, the support unit 300, and a combination thereof.

Meanwhile, the main body unit 100 may have an umbrella storage part 120 capable of storing an umbrella U.

This configuration will be described with reference to FIGS. 19 and 20. Specifically, FIG. 19 is a view illustrating the umbrella storage part of the bag equipped with the deployable chair according to the embodiment of the present invention, and FIG. 20 is a view for explaining a separation prevention member of the umbrella storage part of the bag equipped with the deployable chair according to the embodiment of the present invention.

In particular, the main body unit 100 may have the umbrella storage part 120 that allows the user to use the umbrella U on a rainy day or store the umbrella U to carry the umbrella U.

In this case, the umbrella storage part 120 may be penetratively formed toward the ground surface and disposed at the upper side of the main body unit 100. The umbrella storage part 120 may store all types of umbrellas U. The umbrella storage part 120 may include a separation prevention member 122 rotatably provided on the main body unit 100 and configured to surround the umbrella U and prevent the umbrella U from separating by rotating toward the umbrella U.

However, the umbrella storage part 120 may be configured as a separate member and store the umbrella U without interfering with the space of the seating unit 200.

In more detail, a storage coupling part (not illustrated) capable of being coupled to the umbrella storage part 120 may be provided on the lower portion of the seat part 240. The user may store the umbrella U in the separately provided umbrella storage part 120 and couple the umbrella storage part 120 to the storage coupling part provided on the lower portion of the seat part 240, such that the user's comfort may be improved. The umbrella U stored in the umbrella storage part 120 may be fixed by the separation prevention member 122 so as not to separate from the umbrella storage part 120, such that the user does not feel uncomfortable due to the umbrella U while the user has the seating space.

In addition, one side of the separately provided umbrella storage part 120 may be coupled to the storage coupling part provided on the lower portion of the seat part 240. The umbrella storage part 120 may have a holder (not illustrated) provided at the other side thereof and configured to fix the umbrella U to prevent the umbrella U from swaying. When it rains suddenly, the user may open the umbrella U, mount the umbrella U on the holder, and then take a rest in the state in which the seating space is provided.

Further, the umbrella storage part 120 may rotate in a state of being coupled to the storage coupling part. Therefore, the user may change an angle of the umbrella storage part 120 to conform to a direction of wind and thus take shelter from rain in the state in which the seating space is provided.

While the exemplary embodiments according to the present invention have been described above, it is obvious to those skilled in the art that the present invention may be specified in other particular forms in addition to the aforementioned embodiments without departing from the spirit or the scope of the present invention. Accordingly, it should be understood that the aforementioned embodiments are not restrictive but illustrative, and thus the present invention is not limited to the aforementioned description, and may be modified within the scope of the appended claims and the equivalent range thereto.

The invention claimed is:

1. A bag equipped with a deployable chair, the bag comprising:

a main body unit having a space therein;

a seating unit rotatably coupled to the main body unit and configured to rotate so as to provide a seating space; and a support unit configured to have a variable length from the main body unit toward the ground and support the seating space, wherein, to provide the seating space, the seating unit is rotated and fixed in a state in which one side of the seating unit is coupled to the main body unit by means of a shaft, and wherein the seating unit comprises:

angle adjustment parts provided at two opposite ends of the shaft to rotate so that a part of the angle adjustment part has a radius of curvature about the shaft, the angle adjustment parts each having a projection formed at a periphery having the radius of curvature;

catching parts provided on the main body unit so as to be tiltable toward the angle adjustment parts and each having one side that tilts toward the projection to fix a rotation of each of the angle adjustment parts; and a third manipulation part configured to control the catching part to adjust the rotations of the angle adjustment parts.

2. The bag of claim 1, wherein the support unit changes in length to adjust a gradient of the seating space according to an inclination of the ground, and the support unit is fixed to support the seating space.

3. The bag of claim 2, wherein the support unit comprises:

lifting parts each elongated toward the ground and having a plurality of holes formed in a longitudinal direction thereof, the lifting parts each being configured to move upward or downward at a lateral side of the main body unit;

fixing parts each provided on the main body unit so as to be inserted into or withdrawn from the plurality of holes, the fixing parts each being configured to be inserted into any one of the plurality of holes to adjust a position of the lifting part; and a first manipulation part tiltably provided on the main body unit and connected to the fixing parts, the first manipulation part being configured to control the fixing parts so that the fixing parts are inserted into or withdrawn from the plurality of holes according to a movement position of the first manipulation part.

4. The bag of claim 3, wherein a lower portion of the first manipulation part and the fixing parts are connected by means of first wire members, and the fixing parts are inserted or withdrawn by means of the first wire members according to a tilting direction of the first manipulation part.

5. The bag of claim 3, wherein the fixing part has at least one or more protrusion members protruding toward the lifting part so as to be insertable into the plurality of holes.

6. The bag of claim 3, wherein the support unit further comprises:

a link part configured to connect the lifting parts; and a second manipulation part coupled to the main body unit so as to be movable upward or downward in a direction perpendicular to the ground and configured to move the link part upward or downward according to the movement direction.

7. The bag of claim 6, wherein the second manipulation part comprises:

a lever member disposed at an upper side of the main body unit and configured to move the link part upward or downward;

a foldable member having a plurality of panels hingedly coupled to one another while intersecting one another, the foldable member having one side and the other side respectively slidably coupled to the main body unit and the link part, respectively, wherein when two opposite ends of one side of the foldable member slide toward each other, two opposite ends of the other side of the foldable member slide toward each other, and the foldable member is extended upward as the one side and the other side thereof move away from each other; and second wire members configured to connect the lever member and one side of the foldable member so that the two opposite ends of the one side of the foldable member move toward each other as the lever member moves upward.

8. The bag of claim 7, wherein the foldable member is configured such that a pair of panels hingedly coupled to each other at central portions thereof while intersecting each other in an intersecting state is provided as a basic unit, a plurality of basic units are disposed in the movement direction of the link part, and the adjacent basic units are hingedly coupled to each other.

9. The bag of claim 1, wherein one side of the catching part, which is tilted toward the projection, protrudes toward the projection so that the rotation of the catching part is stopped as the catching part is caught by the projection.

10. The bag of claim 1, wherein the third manipulation part comprises third wire members disposed below the third manipulation part, and each of the third wire members separates one side of the catching part from the projection by pulling the other side of the catching part toward the main body unit to remove the seating space when the third manipulation part is pressed.

11. The bag of claim 1, wherein the seating unit comprises:

a seat part coupled to the main body unit and configured to rotate so as to provide the seating space;

leg parts hingedly coupled to a lower portion of the seat part and configured to support the seat part while rotating toward the ground; and hinge movement parts each having one end hingedly coupled to each of the leg parts and the other end slidably coupled to the lower portion of the seat part so as to adjust a distance from the main body unit.

12. The bag of claim 11, wherein when the hinge movement part slides toward the main body unit, the hinge movement part pulls the leg part and rotates the leg part toward the lower portion of the seat part.

13. The bag of claim 12, wherein the hinge movement part has a bar member elongated in a direction perpendicular to a movement direction of the hinge movement part so that the hinge movement part is slid by external force.

14. The bag of claim 13, wherein the seat part has a long hole formed in the movement direction of the hinge movement part so that a user moves the bar member at a location above the long hole.

15. The bag of claim 1, wherein the main body unit has an umbrella storage part configured to accommodate an umbrella.

16. The bag of claim 15, wherein the umbrella storage part is penetratively formed toward the ground and disposed at an upper side of the main body unit, and the umbrella storage part has a separation prevention member wound around a part of the umbrella by rotating toward the umbrella storage part from the main body unit to fix the umbrella inserted into the umbrella storage part.

17. The bag of claim 1, wherein a water bottle storage part is provided at a lateral side of the main body unit to accommodate a water bottle.

18. The bag of claim 17, wherein the water bottle storage part is formed elastically to be extended or retracted depending on types of water bottles to correspond to the water bottle.

19. The bag of claim 1, wherein the main body unit is coupled to a storage device disposed at a side opposite to a side at which the seating space is provided, and the storage device is configured to accommodate an item.

* * * * *